US007906210B2

(12) United States Patent
Sato et al.

(10) Patent No.: US 7,906,210 B2
(45) Date of Patent: Mar. 15, 2011

(54) FIBROUS NANOCARBON AND METAL COMPOSITE AND A METHOD OF MANUFACTURING THE SAME

(75) Inventors: Tomoyuki Sato, Hanishina-Gun (JP); Susumu Arai, Nagano (JP)

(73) Assignees: Nissei Plastic Industrial Co., Ltd., Hanishina-gun (JP); Shinshu University, Nagano-ken (JP)

( * ) Notice: Subject to any disclaimer, the term of this patent is extended or adjusted under 35 U.S.C. 154(b) by 860 days.

(21) Appl. No.: 11/257,742

(22) Filed: Oct. 25, 2005

(65) Prior Publication Data

US 2008/0008870 A1 Jan. 10, 2008

(30) Foreign Application Priority Data

Oct. 27, 2004 (JP) ..... 2004-312901

(51) Int. Cl.
*B32B 9/00* (2006.01)

(52) U.S. Cl. ..... 428/408; 423/447.1

(58) Field of Classification Search ..... 428/408; 977/742; 106/162
See application file for complete search history.

(56) References Cited

U.S. PATENT DOCUMENTS

| | | | | | |
|---|---|---|---|---|---|
| 3,008,883 | A * | 11/1961 | Passal | 205/277 |
| 3,474,010 | A * | 10/1969 | McMullen et al. | 205/113 |
| 3,617,320 | A * | 11/1971 | Lee | 106/198.1 |
| 4,108,740 | A * | 8/1978 | Wearmouth | 101/348 |
| 6,106,927 | A * | 8/2000 | Zhong et al. | 428/141 |
| 2001/0025962 | A1 * | 10/2001 | Nakamoto | 257/137 |
| 2003/0019756 | A1 * | 1/2003 | Yoshida et al. | 205/88 |
| 2006/0099438 | A1 | 5/2006 | Arai et al. | |

FOREIGN PATENT DOCUMENTS

| | | | |
|---|---|---|---|
| JP | 5-222589 | A | 8/1993 |
| JP | 6-146070 | A | 5/1994 |
| JP | 2002-317299 | A | 10/2002 |
| JP | 2004-156074 | A | 6/2004 |
| JP | 2005-290463 | | 10/2005 |

OTHER PUBLICATIONS

Decision of Rejection issued by the Japanese Patent Office Jul. 1, 2008 in corresponding Japanese patent application 2004-312901.
Chen et al. Composite Electrodeposites of Nickel-Carbon Nanotubes. Surface Technology, vol. 32(2), Apr. 2002.

* cited by examiner

*Primary Examiner* — Angela Ortiz
*Assistant Examiner* — Daniel Miller
(74) *Attorney, Agent, or Firm* — Hamre, Schumann, Mueller & Larson, P.C.

(57) ABSTRACT

A composite plating layer contains carbon nanofibers. A composite plating solution contains a Watts bath composed mainly of nickel sulfate and nickel chloride, a brightening agent, a surface active agent and carbon nanofibers. Polyacrylic acid is used as the surface active agent.

3 Claims, 1 Drawing Sheet

FIBROUS NANOCARBON AND METAL COMPOSITE AND A METHOD OF MANUFACTURING THE SAME

FIELD OF THE INVENTION

This invention relates to a fibrous nanocarbon and metal composite presenting a smooth surface and a method of manufacturing the same.

BACKGROUND OF THE INVENTION

The plating of a metal surface with a metal film is widely employed for protecting it and improving its appearance. There is also proposed a composite plating material containing a metal and an ultrafine carbonaceous material having a diameter of 1.0 to 50 nm (nanometers) and called nanocarbon. The carbonaceous material is outstanding in thermal and electrical conductivity and can be combined with a metal to improve its thermal and electrical properties.

We, the inventors of this invention, have already proposed a composite plating material containing nanocarbon and a metal in Japanese Patent Application No. 2005-290463.

We have proposed a product coated with a composite plating layer formed by employing a composite plating solution prepared by adding carbon nanofibers and a surface active agent to a metallic plating solution. The composite plating layer contains 50 to 98% by volume of plating metal and 2 to 50% by volume of carbon nanofibers. Although carbon nanofibers are normally low in wettability, the surface active agent improves their wettability and thereby makes a product of good durability.

The product will be described with reference to FIG. 3.

FIG. 3 shows a section of a plating film 101 formed on an iron plate 100 by a combination of zinc deposited thereon and carbon nanofibers dispersed therein as examined under an electron microscope. The film 101 first has a thickness of less than 10 μm and contains carbon nanofibers dispersed therein substantially uniformly. Then, an uneven surface is formed thereon mainly by protruding zinc particles 102 containing carbon nanofibers, zinc deposited thereafter is concentrated on the protruding zinc particles 102 and carbon nanofibers 103 are also concentrated thereon and combined with zinc.

According to the basic principle of the growth of a plating film, the deposition of a metal ion does not occur uniformly on the whole surface of a plating film formed, but is concentrated on protruding portions thereof. As the deposition of the metal is concentrated on protruding portions, hardly any deposition or any appreciable growth of the plating film occurs in recessed portions. Accordingly, an uneven surface formed during the initial period of metal deposition becomes still more uneven with the progress of a plating operation.

The foregoing is considered to explain the reason why carbon nanofibers are concentrated on the protruding portions on which metal deposition is concentrated. In fact, the examination by an electron micrograph reveals the concentration of carbon nanofibers on protruding portions.

As the protruding portions are formed on its outer surface, the plating film 101 formed by a known method of composite plating does not improve the outward appearance of the iron plate 100. When a composite plating film, such as 101, formed on a metallic material, such as iron plate 100, to improve its thermal and electrical properties impairs its appearance, composite plating has only a limited scope of applicability. Composite plating is required to be able to form a smooth surface in order to have an expanded scope of applicability.

SUMMARY OF THE INVENTION

According to one aspect of this invention, there is provided a fibrous nanocarbon and metal composite comprising a composite plating layer of nickel and fibrous nanocarbon formed by electroplating metallic materials in a composite plating solution prepared by adding a brightening agent, polyacrylic acid and carbon nanofibers to a Watts bath composed mainly of nickel sulfate and nickel chloride.

The fibrous nanocarbon and metal composite of this invention has a surface roughness improved to about 1/50 of that which has hitherto been obtained on the same kind of material. The plating layer according to this invention has a fully smooth surface, as will become obvious layer. The plating layer has a good appearance owing to its smooth surface despite the presence of carbon nanofibers, and excellent thermal and electrical properties owing to the carbon nanofibers.

According to another aspect of this invention, there is provided a method of manufacturing a fibrous nanocarbon and metal composite which comprises adding a brightening agent, polyacrylic acid and carbon nanofibers to a Watts bath composed mainly of nickel sulfate and nickel chloride to prepare a composite plating solution, and electroplating metallic materials in the plating solution to form a composite plating layer of nickel and fibrous nanocarbon thereon.

The method of this invention can form a plating layer having a surface roughness improved to about 1/50 of that which has hitherto been obtained on the same kind of material. It can form on a metallic material a plating layer having a good appearance owing to its smooth surface despite the presence of carbon nanofibers, and excellent thermal and electrical properties owing to the carbon nanofibers. Thus, it gives a drastically expanded scope of applicability to composite plating performed by employing carbon nanofibers.

The brightening agent is preferably a combination of saccharin sodium and 2-butyne-1,4-diol. Some brightening agents have poor compatibility with a dispersing agent (or a surface active agent), and form an uneven surface, or weaken its performance. Saccharin sodium and 2-butytn-1,4-diol, however, have good compatibility with a surface active agent and do not hinder its performance. Accordingly, they improve the quality of plating.

The plating solution preferably contains 0.1 to 1.0 kg of polyacrylic acid and 2 to 20 kg of carbon nanofibers per cubic meter. If it contains only less than 0.1 kg of polyacrylic acid per cubic meter, the acid has so low a dispersing power as to allow the cohesion of carbon nanofibers. Over 1.0 kg of polyacrylic acid per cubic meter is, however, excessive and the acid undesirably forms a product of decomposition precipitated in the plating solution and lowering the quality of plating. The presence of only less than 2 kg of carbon nanofibers per cubic meter of solution is insufficient and results in a plating layer containing only an insufficient amount of carbon nanofibers, while the presence of over 20 kg is also undesirable, since the solution requires a larger amount of surface active agent.

BRIEF DESCRIPTION OF THE DRAWINGS

Certain preferred embodiments of this invention will now be described in detail, by way of example only, with reference to the accompanying drawings, in which.

DETAILED DESCRIPTION OF THE PREFERRED EMBODIMENTS

Figure 1:
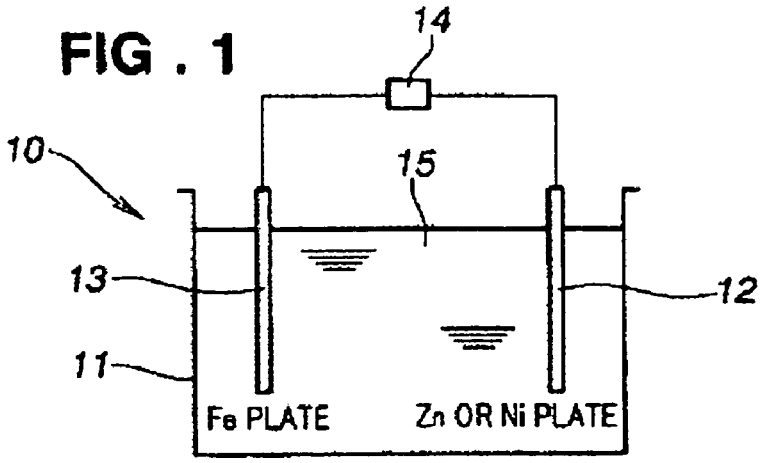
FIG. 1 is a diagram showing the basic structure of an apparatus used for carrying out electroplating according to this invention.

Initial reference is made to FIG. 1 diagrammatically showing the basic structure of an apparatus used for carrying out electroplating according to this invention. The electroplating apparatus 10 has a plating tank 11 containing a plating solution 15 in which a zinc or nickel plate 12 is immersed as the positive electrode, and an iron, aluminum, copper or stainless steel plate 13 as the negative electrode, a power source 14 being connected between the two plates 12 and 13. The plating solution 15 will be described below. Devices for stirring and circulating the plating solution 15 are also essential, but will not be described, since known devices can be employed.

The plating solution 15 contains water, zinc chloride, ammonium chloride, a surface active agent and carbon nanofibers according to Comparative Example 1, and water, nickel sulfate, nickel chloride, boric acid, a brightening agent, a surface active agent and carbon nanofibers according to Example 1 of this invention. The composition of the plating solution will be stated later.

According to Comparative Example 1, a zinc ion and carbon nanofibers reach the metal plate 13. A film of a mixture of zinc and carbon nanofibers is, therefore, formed on the metal plate 13.

Positive electrode: Zinc plate (Comparative Example 1), electrolytic nickel plate (Example 1)

Plating solution temperature: 25° C.

Current density: 5 A/dm$^2$

Duration of treatment: 3 minutes and 30 seconds (20 minutes in Examples 1-2 and Comparative Example 1-2)

Composition of the Plating Solution Used in Comparative Example 1:

Water: 1.0 m$^3$

Zinc chloride: 70 kg/m$^3$

Ammonium chloride: 180 kg/m$^3$

Surface active agent: A surface active agent obtained by mixing a nonionic surface active agent with 2, 4, 7, 9-tetramethyl-5-desine-4,7-diol (Trade name: OLFIN PD-002W, product of Nisshin Kagaku Kogyo K.K.): 2,000 cm$^3$/m$^3$ Carbon nanofibers: 2 kg/m$^3$ Composition of the Plating Solution Used in Example 1:

Water: 1.0 m$^3$

Nickel(II) sulfate hexahydrate: 240 kg/m$^3$

Nickel(II) chloride hexahydrate: 45 kg/m$^3$

Boric acid: 30 kg/m$^3$

Brightening agent: Saccharin sodium, 2 kg/m$^3$ and 2-butyne-1,4-diol, 0.2 kg/m$^3$ Surface active agent: Polyacrylic acid, 0.1 kg/m$^3$ Carbon nanofibers: 2 kg/m$^3$ In Comparative Example 1 and Example 1, the plating solution was subjected to ultrasonic vibration when carbon nanofibers were mixed therein. This promoted the dispersion of carbon nanofibers in the solution.

The results of the experiments are shown in Table 1. The surface roughness Ra was examined under a laser microscope. Ra is the centerline average roughness as defined by JIS B0601.

The conditions employed for Comparative Example 1-2 and Example 1-2 were identical to those for Comparative Example 1 and Example 1, respectively, except the duration of treatment.

TABLE 1

| | Plating solution | Surface active agent | Positive electrode | Negative electrode | Duration of treatment | Surface roughness Ra |
|---|---|---|---|---|---|---|
| Comparative Example 1 | Zinc chloride<br>Ammonium chloride | PD-002W | Zinc plate | Iron plate | 3 min. 30 sec. | 10 μm |
| Example 1 | Nickel(II) sulfate hexahydrate<br>Nickel(II) chloride hexahydrate<br>Boric acid | Polyacrylic acid | Nickel plate | Iron plate | 3 min. 30 sec. | 0.75 μm (1/13) |
| Comparative Example 1-2 | Zinc chloride<br>Ammonium chloride | PD-002W | Zinc plate | Iron plate | 20 min. | 40 μm |
| Example 1-2 | Nickel sulfate<br>Nickel chloride<br>Boric acid | Polyacrylic acid | Nickel plate | Iron plate | 20 min. | 0.8 μm (1/50) |

According to Example 1, a nickel ion and carbon nano fibers reach the metal plate 13. A film of a mixture of nickel and carbon nanofibers is, therefore, formed on the metal plate 13.

EXAMPLES OF EXPERIMENTS

Several examples of experiments according to this invention will now be described. This invention is, however, not limited to these examples.

Common Electroplating Conditions:

Negative electrode: Iron plate (degreased and clean)

Figure 3:
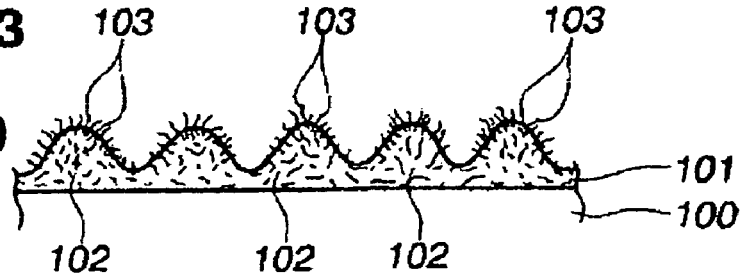
FIG . 3 (Prior Art)
FIG. 3 is a view showing a section of particles in a plating layer formed by a known method.

A surface roughness of 0.75 μm was obtained in Example 1, while a surface roughness of 10 μm was obtained in Comparative Example 1 (see FIG. 3). When the surface roughness obtained in Comparative Example 1 was taken as 1, the value obtained in Example 1 was 1/13, confirming that a satisfactorily smooth surface could be obtained in Example 1.

A surface roughness of 0.8 μm was obtained in Example 1-2, while a surface roughness of 40 μm was obtained in Comparative Example 1-2. When the surface roughness obtained in Comparative Example 1-2 was taken as 1, the value obtained in Example 1-2 was 1/50, confirming that a still smoother surface could be obtained in Example 1-2.

As the surface active agent used in Example 1 was polyacrylic acid, while PD-002W was used in Comparative Example 1, it was found that polyacrylic acid made a smooth surface, while PD-002W made an uneven one. However, it was necessary to examine whether the surface active agent would have any effect on the plating solution, since the solution used in Example 1 was a nickel bath, while a zinc bath was used in Comparative Example 1.

An experiment was, therefore, made as Comparative Example 2 by repeating the conditions of Example 1 except the surface active agent.

Composition of the Plating Solution Used in Comparative Example 2:

Water: 1.0 $m^3$

Nickel(II) sulfate hexahydrate: 240 $kg/m^3$

Nickel(II) chloride hexahydrate: 45 $kg/m^3$

Boric acid: 30 $kg/m^3$

Brightening agent: Saccharin sodium, 2 $kg/m^3$ and 2-butyne-1,4-diol, 0.2 $kg/m^3$ Surface active agent: A surface active agent obtained by mixing a nonionic surface active agent with 2, 4, 7, 9-tetramethyl-5-desine-4,7-diol (Trade name: OLFIN PD-002W, product of Nisshin Kagaku Kogyo K.K.): 2,000 $cm^3/m^3$ Carbon nanofibers: 2 $kg/m^3$ A greater surface roughness occurred from Comparative Example 2 than from Example 1. There was formed only a brittle composite plating layer. It was, therefore, concluded that polyacrylic acid could form a smooth and hard surface, while PD-002W formed an uneven and brittle surface.

After the experiments for examining the surface roughness as described above, experiments were made for examining the amount of carbon nanofibers to be employed.

The experiments were made by varying the amount of carbon nanofibers and otherwise repeating Example 1.

Composition of the Plating Solutions Used in Examples 1 to 5 and Comparative Example 3:

Water: 1.0 $m^3$

Nickel(II) sulfate hexahydrate: 240 $kg/m^3$

Nickel(II) chloride hexahydrate: 45 $kg/m^3$

Boric acid: 30 $kg/m^3$

Brightening agent: Saccharin sodium, 2 $kg/m^3$ and 2-butyne-1,4-diol, 0.2 $kg/m^3$ Surface active agent: Polyacrylic acid, 0.1 $kg/m^3$ Carbon nanofibers: 2 $kg/m^3$ (Example 1), 4 $kg/m^3$ (Example 2), 6 $kg/m^3$ (Example 3), 12 $kg/m^3$ (Example 4), 20 $kg/m^3$ (Example 5) and 30 $kg/m^3$ (Comparative Example 3).

The products of Examples 1 to 5 and Comparative Example 3 were examined for the quality of metal and carbon combination and the surface condition. The results are shown in Table 2, in which OO means 'excellent', O means 'good' and 'x' means 'bad and unacceptable'.

TABLE 2

| | Carbon nanofibers | Surface condition | Quality of combination | Evaluation |
|---|---|---|---|---|
| Example 1 | 2 $kg/m^3$ | ○○ | ○ | ○ |
| Example 2 | 4 $kg/m^3$ | ○○ | ○ | ○ |
| Example 3 | 6 $kg/m^3$ | ○○ | ○○ | ○○ |
| Example 4 | 12 $kg/m^3$ | ○○ | ○○ | ○○ |
| Example 5 | 20 $kg/m^3$ | ○○ | ○ | ○ |
| Comparative Example 3 | 30 $kg/m^3$ | ○○ | x | x |

All the products showed an excellent surface condition owing to polyacrylic acid. They were, however, evaluated differently for the quality of combination depending on the uniform distribution of carbon nanofibers.

In Comparative Example 3, an excess of carbon nanofibers and a shortage of the surface active agent resulted in a partial cohesion of carbon nanofibers making a composite of low quality. In Examples 1 and 2, a shortage of carbon nanofibers resulted in an uneven, but permissible distribution thereof. The same occurred in Example 5.

Accordingly, it is adequate for the plating solution to contain 2 to 20 kg, and preferably 6 to 12 kg, of carbon nanofibers per cubic meter.

As is obvious from the foregoing, the amount of polyacrylic acid added as a dispersing agent for avoiding the cohesion of carbon nanofibers is an important matter. A comparison was, therefore, made between the amount of carbon nanofibers and the amount of polyacryic acid to be employed. The results will be explained with reference to FIG. 2.

Figure 2:
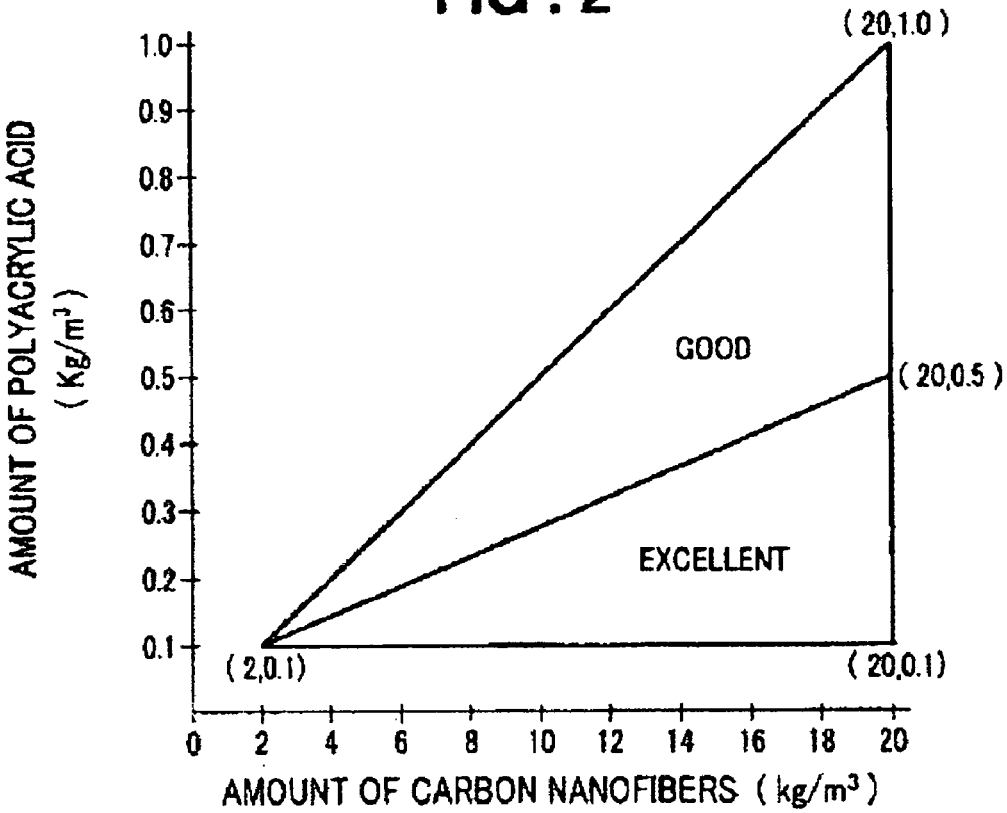
FIG. 2 is a graph comparing the amounts of carbon nanofibers and polyacrylic acid which are employed in accordance with this invention.

FIG. 2 is a graph comparing the amounts of carbon nanofibers and polyacrylic acid to be employed in the plating solution in accordance with this invention. The horizontal axis represents the amount of carbon nanofibers and the vertical axis represents the amount of polyacrylic acid.

When the amount of polyacrylic acid was 0.1 kg/m3, a good or excellent metal and carbon combination was obtained when the amount of carbon nanofibers was in the range of 2 to 20 kg/m3, as stated above with reference to Table 2. When the amount of polyacrylic acid was reduced from 0.1 kg/m3, its dispersing power was so low as to allow the cohesion of carbon nanofibers. Over 1.0 kg/m3 was, however, excessive, and it formed a product of decomposition precipitated in the plating solution and lowering the quality of plating.

As the amount of polyacrylic acid has to be increased in proportion to the carbon nanofibers, the adequate amounts thereof are defined as falling within the area shown by a large triangle connecting the coordinate points (2, 0.1), (20, 0.1) and (20, 1.0) in FIG. 2. This area is shown as indicating a 'Good' range. However, as an excess of polyacrylic acid results in a marked increase in the precipitation of a product of its decomposition, its amount had better be rather small. It was experimentally found that the optimum amounts were defined as falling within the area shown by a small triangle connecting the coordinate points (2, 0.1), (20, 0.1) and (20, 0.5) in FIG. 2. This area is shown as indicating an 'Excellent' range.

Thus, the amounts of carbon nanofibers and polyacrylic acid should be selected from within the Good range and preferably from within the Excellent range.

The dispersion of carbon nanofibers in the plating solution is so important for this invention that even if the plating solution may be of the composition as employed in Example 1, no satisfactory metal and carbon combination can be obtained unless carbon nanofibers are satisfactorily dispersed in the plating solution.

The mere addition of carbon nanofibers and a surface active agent to a nickel plating solution does not immediately result in their dispersion. Their satisfactory dispersion requires a dispersing job carried out by repeating ultrasonic vibration and stirring alternately for a certain length of time.

Experiments teach that at least one hour of dispersion is required for forming a good metal and carbon combination, as shown in Table 3 below.

TABLE 3

| Time for dispersion by ultrasonic vibration and stirring | State of dispersion and combination |
|---|---|
| 10 min. | x |
| 30 min. | Δ |
| 60 min. | ○ |
| 120 min. | ○ |
| 240 min. | ○○ |
| 480 min. | ○○ |

Δ means 'Fair or acceptable'.

Δ means 'Fair or acceptable'.

The amount of the surface active agent may be increased if carbon nanofibers are not dispersed easily when the amount thereof is increased. The mere increase of the surface active agent can, however, bring about an adverse result, since the dispersion of carbon nanofibers requires a considerably long time, as shown in Table 3.

Therefore, when carbon nanofibers are, for example, employed in the amount of 20 kg/m$^3$, it is not advisable to start the amount of the surface active agent with 1 kg/m$^3$, but it is advisable to start with a smaller amount and increase it little by little to ascertain the state of dispersion, so that no further increase of the surface active agent may be made if no cohesion of carbon nanofibers is visible after a job of thorough dispersion.

Moreover, if carbon nanofibers in the amount of more than 2 kg/m$^3$ are put in the plating solution at a time, they are very poorly dispersible in the solution and their satisfactory dispersion requires a larger amount of surface active agent than usual. When carbon nanofibers are employed in the total amount of 20 kg/m$^3$, it is advisable to start by adding the surface active agent in the amount of 0.1 kg/m$^3$ and carbon nanofibers in the amount of 2 kg/m$^3$ and stirring the solution or giving it ultrasonic vibration to disperse carbon nanofibers therein.

Then, carbon nanofibers are increased by 2 kg/m$^3$ at a time and the job of dispersing them is repeated. The gradual increase of carbon nanofibers as stated makes their dispersion possible by a smaller amount of surface active agent than is required when all of the nanofibers are added at a time.

If the increase of carbon nanofibers by 2 kg/m$^3$ and the repeated stirring or vibration of the solution result in a definite worsening of the state of their dispersion, the addition of a small amount of surface active agent and the repeated stirring or vibration make it possible to disperse even a large amount of carbon nanofibers satisfactorily with a small amount of surface active agent.

Description will now be made of evaluation as to thermal properties (emissivity and thermal conductivity).

Comparative Example 4 was an experiment made in the absence of carbon nanofibers for comparison with Examples 1, 3 and 4.

Composition of the Plating Solution Used in Comparative Example 4:

Water: 1.0 m$^3$

Nickel(II) sulfate hexahydrate: 240 kg/m$^3$

Nickel(II) chloride hexahydrate: 45 kg/m$^3$

Boric acid: 30 kg/m$^3$

Brightening agent: Saccharin sodium, 2 kg/m$^3$ and 2-butyne-1,4-diol, 0.2 kg/m$^3$ Surface active agent: Polyacrylic acid, 0.1 kg/m$^3$ Emissivity was determined at $\lambda$=10 μm by employing an emissivity measuring device. The results are shown in Table 4.

TABLE 4

| | Carbon nanofibers | Emissivity | Evaluation |
|---|---|---|---|
| Comparative Example 4 | 0 kg/m$^3$ | 0.07 | x |
| Example 1 | 2 kg/m$^3$ | 0.80 | ○ |
| Example 3 | 6 kg/m$^3$ | 0.85 | ○ |
| Example 4 | 12 kg/m$^3$ | 0.86 | ○ |

The plating layer formed in Comparative Example 4 had an emissivity of as low as 0.07, since it was a nickel layer. It was substantially equal to that of any ordinary nickel plating layer. On the other hand, all of the plating layers formed in Examples 1, 3 and 4 and containing carbon nanofibers showed by far higher levels of emissivity, as high as 0.80 according to Example 1, 0.85 according to Example 3 and 0.86 according to Example 4.

When a plating layer formed on the outer surface of a metal box containing a source of heat, such as a power transistor, has a low emissivity, only a small amount of radiant heat is released from the outer surface of the box. The heat generated by e.g. the power transistor is confined in the metal box and raises its temperature which in turn raises the temperature of the power transistor and thereby deteriorates it. If the emissivity of the plating layer is high, heat is not confined in the metal box, but its temperature drops, thereby allowing the power transistor to have a lower temperature and a longer life.

The thermal conductivity of each of the products of Comparative 4 and Examples 1, 3 and 4 was determined by a laser flash method. The results are shown in Table 5.

TABLE 5

| | Carbon nanofibers | Thermal conductivity |
|---|---|---|
| Comparative Example 4 | 0 kg/m$^3$ | 60-70 W/mk |
| Example 1 | 2 kg/m$^3$ | 65-75 W/mk |
| Example 3 | 6 kg/m$^3$ | 80-90 W/mk |
| Example 4 | 12 kg/m$^3$ | 80-90 W/mk |

While the thermal conductivity of the product of Comparative Example 4 was from 60 to 70 W/mk, the products containing carbon nanofibers showed an increase in thermal conductivity to from 65 to 75 W/mk according to Example 1 and from 80 to 90 W/mk according to both of Examples 3 and 4.

As the thermal conductivity of a material depends greatly on its thickness, the thickness of a plating layer having a large thickness from 100 um to 1 mm affects its thermal conductivity greatly, though a thickness in the order of several microns hardly does.

A metal box for a power transistor is usually formed from a metal plate having a thickness of 0.5 to 1.0 mm. A plating layer formed on such a box and having a large thickness from 0.1 to 1.0 mm lowers the temperatures of the box and power transistor if it has a high thermal conductivity. Thus, it is preferable to form a plating layer of high emissivity on a metal box for holding any source of heat.

Then, the plating layers were evaluated for mechanical properties. The hardness of each plating layer was examined for its evaluation as to mechanical properties. The results are shown in Table 6.

TABLE 6

| | Carbon nanofibers | Vickers hardness | Evaluation |
|---|---|---|---|
| Comparative Example 4 | 0 kg/m$^3$ | 476 | x |
| Example 3 | 6 kg/m$^3$ | 559 | ○ |
| Example 4 | 12 kg/m$^3$ | 648 | ○ |

While Comparative Example 4 showed a Vickers hardness of 476, carbon nanofibers increased it to 559 according to Example 3 and 648 according to Example 4. As an ordinary gloss nickel plating layer has a hardness of 400 to 500, Examples 3 and 4 are quite satisfactory in their hardness. The hardness of 648 as obtained in Example 4 is particularly high and comparable to that of an electroless nickel-phosphorus plating layer as hardened at 250° C.

A harder plating layer is more resistant to scratching and more suitable for protecting a soft metal. Thus, the plating layer according to this invention presents a good appearance owing to its smoothness, forms an optimum skin for a metal box for holding a source of heat owing to its high emissivity and provides a good protection for any underlying metal owing to its high hardness. Therefore, it provides a plating layer offering an added value which has not been available with any known gloss nickel plating layer.

Experiments were also conducted in cases where aluminum, copper and stainless steel plates were used instead of the iron plate as the metal plate 13. It was confirmed that this invention was effectively applicable to all of the cases without presenting any problem of adhesion.

As is obvious from the foregoing, this invention is suitable as a plating layer covering a metal box holding a power transistor.

Obviously, various minor changes and modifications of the present invention are possible in the light of the above teaching. It is therefore to be understood that within the scope of the appended claims the invention may be practiced otherwise than as specifically described.

What is claimed is:

1. A fibrous nanocarbon and metal composite, comprising:

a composite plating layer of nickel and fibrous nanocarbon, formed by electroplating metallic materials in a composite plating solution, wherein the composite plating solution includes a Watts bath, a brightening agent, polyacrylic acid, carbon nanofibers, and a dispersing agent that reduces cohesion of carbon nanofibers, wherein the polyacrylic acid smoothes a surface of the composite plating layer, wherein the Watts bath includes nickel sulfate, and nickel chloride, wherein the dispersing agent is polyacrylic acid, and wherein the plating solution includes:

0.1 to 1.0 kg of polyacrylic acid per cubic meter of the plating solution, and 2 to 20 kg of carbon nanofibers per cubic meter of the plating solution.

2. A method of manufacturing a fibrous nanocarbon and metal composite, comprising:

adding a brightening agent, polyacrylic acid, and carbon nanofibers to a Watts bath, wherein the polyacrylic acid smoothes a surface of the nanocarbon and metal composite, wherein the Watts bath includes nickel sulfate, and nickel chloride;

preparing a plating solution, that includes:

a dispersing agent for reducing cohesion of the carbon nanofibers;

dispersing the carbon nanofibers in the plating solution;

electroplating metallic materials in the plating solution;

forming a composite plating layer of nickel and fibrous nanocarbon, wherein the dispersing agent is polyacrylic acid, and wherein the plating solution includes:

0.1 to 1.0 kg of polyacrylic acid per cubic meter of the plating solution, and 2 to 20 kg of carbon nanofibers per cubic meter of the plating solution.

3. The method according to claim 2, wherein the brightening agent comprises:

saccharin sodium; and 2-butyne-1,4-diol.

* * * * *